US008260177B2

(12) United States Patent
Takeda et al.

(10) Patent No.: US 8,260,177 B2
(45) Date of Patent: Sep. 4, 2012

(54) CONVEYANCE MEMBER, DEVELOPER CARTRIDGE, AND IMAGE-FORMING APPARATUS

(75) Inventors: Tomohiro Takeda, Minamiashigara (JP); Ryoji Sugimoto, Minamiashigara (JP); Masatoshi Norigoe, Minamiashigara (JP); Hisashi Fukasawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 366 days.

(21) Appl. No.: 12/714,782

(22) Filed: Mar. 1, 2010

(65) Prior Publication Data

US 2011/0013946 A1 Jan. 20, 2011

(30) Foreign Application Priority Data

Jul. 16, 2009 (JP) ..... 2009-167841

(51) Int. Cl.
*G03G 15/08* (2006.01)

(52) U.S. Cl. ..... 399/263

(58) Field of Classification Search ..... 399/256, 399/262, 263

See application file for complete search history.

(56) References Cited

U.S. PATENT DOCUMENTS

| | | | | |
|---|---|---|---|---|
| 7,925,189 | B2 * | 4/2011 | Norigoe | 399/256 |
| 2007/0077100 | A1 | 4/2007 | Suzuki et al. | |
| 2008/0240771 | A1 | 10/2008 | Kurita et al. | |
| 2010/0111574 | A1 * | 5/2010 | Ichikawa | 399/263 |
| 2011/0002714 | A1 * | 1/2011 | Ichikawa et al. | 399/263 |

FOREIGN PATENT DOCUMENTS

| | | | |
|---|---|---|---|
| JP | 2005-221825 | A | 8/2005 |
| JP | 2006-30488 | A | 2/2006 |

* cited by examiner

*Primary Examiner* — David Gray
*Assistant Examiner* — Gregory H Curran
(74) *Attorney, Agent, or Firm* — Sughrue Mion, PLLC

(57) ABSTRACT

A conveyance member includes: a rotating shaft; a plurality of support members that extend from the rotating shaft in a direction crossing an axial direction of the rotating shaft; and a plurality of arcuate members each having one end supported respectively by one of the support members, and having another end extending in a direction other than the axial direction so as to form an arc, wherein: when viewed in a direction perpendicular to the axial direction, there are a plurality of overlapping areas in which adjacent arcuate members overlap in the axial direction; and a length of at least one of the plurality of overlapping areas close to one end of the rotating shaft is greater than a length of each of the overlapping areas in the axial direction toward another end of the rotating shaft.

18 Claims, 10 Drawing Sheets

CONVEYANCE MEMBER, DEVELOPER CARTRIDGE, AND IMAGE-FORMING APPARATUS

CROSS-REFERENCE TO RELATED APPLICATIONS

This application is based on and claims priority under 35 USC 119 from Japanese Patent Application No. 2009-167841 filed on Jul. 16, 2009.

BACKGROUND

1. Technical Field

The present invention relates to a conveyance member, a developer cartridge, and an image-forming apparatus.

2. Related Art

In an image-forming apparatus that develops a latent image with developer, a detachable developer cartridge is used as a supply for replenishing developer to a developing device.

SUMMARY

According to an aspect of the invention, there is provided a conveyance member including: a rotating shaft; a plurality of support members that extend from the rotating shaft in a direction crossing an axial direction of the rotating shaft; and a plurality of arcuate members each having one end supported respectively by one of the support members, and having another end extending in a direction other than the axial direction so as to form an arc, wherein: when viewed in a direction perpendicular to the axial direction, there are a plurality of overlapping areas in which adjacent arcuate members overlap in the axial direction; and a length of at least one of the plurality of overlapping areas close to one end of the rotating shaft is greater than a length of each of the overlapping areas in the axial direction toward another end of the rotating shaft.

BRIEF DESCRIPTION OF THE DRAWINGS

Exemplary embodiments of the present invention will be described in detail based on the following figures, wherein.

DETAILED DESCRIPTION

Following is a description of an exemplary embodiment of the present invention, with reference to the drawings. It is to be noted that in the following figures the longitudinal direction of the image-forming apparatus is denoted as the X-axis direction, and arrows X and −X along the X-axis respectively indicate a front/back direction; the horizontal direction is denoted as the Y-axis direction, and arrows Y and −Y along the Y-axis respectively indicate a right/left direction and the vertical direction is denoted as the Z-axis direction, and arrows Z and −Z along the Z-axis respectively indicate an up/down direction. The longitudinal direction is the main scanning direction of the image-forming apparatus; and the horizontal direction is the sub scanning direction of the image-forming apparatus. The down direction is a direction of gravity. Further, in the figures, a dot appearing in a circle indicates an arrow pointing toward a front of a sheet of paper from its back, and "x" appearing in a circle indicates an arrow pointing toward the back of the sheet of paper from its front.

Overall Configuration of Image-Forming Apparatus

Figure 1:
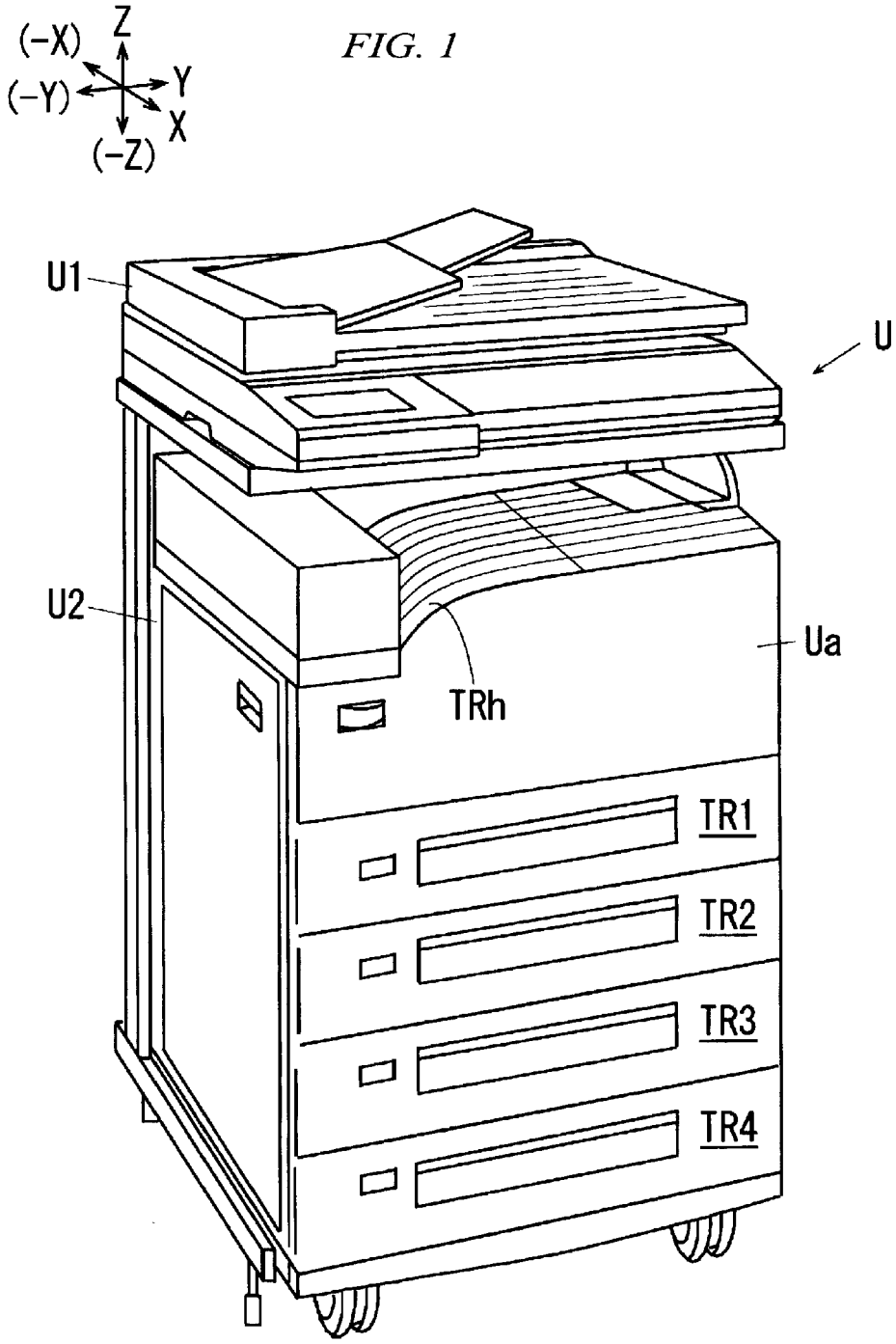
FIG. 1 is a perspective diagram of an image-forming apparatus according to the exemplary embodiment.

FIG. 1 is a perspective diagram of image-forming apparatus U according to the exemplary embodiment. As shown in FIG. 1, image-forming apparatus U includes auto document feeder U1 disposed at the top of image-forming apparatus U, and device body U2 supporting auto document feeder U1. At the top of device body U2, paper output unit TRh, on which sheets (an example of a medium) are outputted, is provided. At the lower part of device body U2, plural paper supply units TR1 to TR4 storing sheets are detachably attached. At the front of the upper part of device body U2, front cover Ua (an example of a front open-close member) is openably supported.

Figure 2:
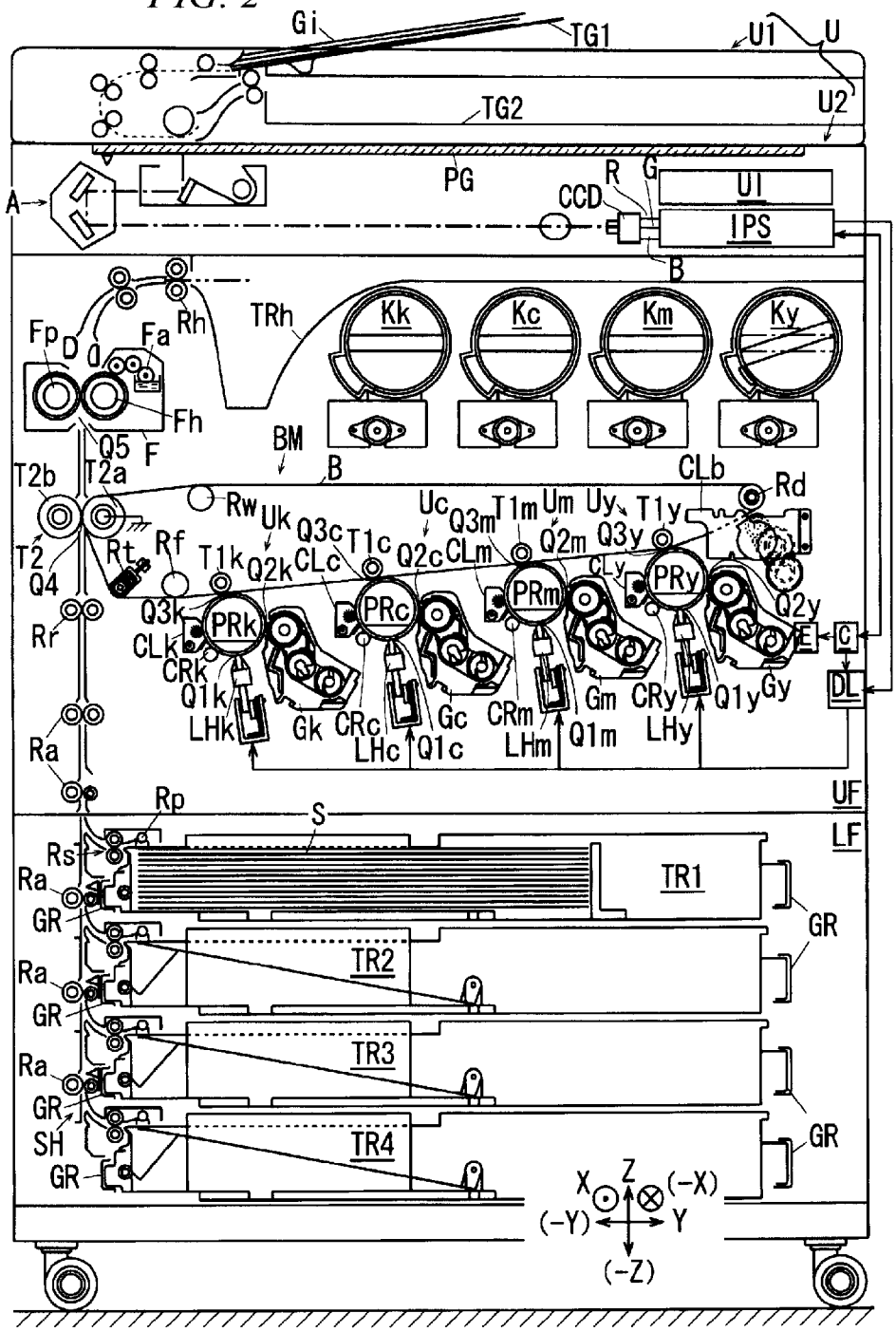
FIG. 2 is a diagram showing an internal configuration of the image-forming apparatus.

FIG. 2 is a diagram showing an internal configuration of image-forming apparatus U. Auto document feeder U1 includes document feeder TG1 and document output unit TG2. On document feeder TG1, plural documents Gi to be copied are stacked. Each document Gi is fed from document feeder TG1, is transported though a document-reading position on transparent document-reading surface PG located at the top of device body U2, and is outputted on document output unit TG2. Auto document feeder U1 further includes operation unit UI, which is operated by a user to input an operation instruction signal, for example, to start an image formation operation, exposure optical system A, and so on. A light from a document transported on document reading surface PG of auto document feeder U1 or manually placed on document reading surface PG is reflected via exposure optical system A to solid-state image sensor CCD. Solid-state image sensor CCD converts the reflected light to electrical signals representing red (R), green (G), and blue (B). Image data converter IPS converts RGB electric signals inputted from solid-state image sensor CCD to image data representing black (K), yellow (Y), magenta (M), and cyan (C), and stores the image data temporarily. Image data converter IPS then outputs the image data to driving circuit DL of latent-image-forming devices. It is to be noted that if a document image is a monochrome image, only black image data is inputted in driving circuit DL. Driving circuit DL includes driving circuits for colors Y, M, C, and K (not shown), and outputs signals corresponding to the inputted image data to latent-image-forming devices LHy, LHm, LHc, and LHk, which are respectively provided for colors Y, M, C, and K.

Visible-image-forming devices Uy, Urn, Uc, and Uk, which are disposed in device body U2, respectively form visible images in colors Y, M, C, and K. Light sources of latent-image-forming devices LFy to LHk respectively irradiate rotating image holders PRy, PRm, PRc, and PRk by Y, M, C, and K latent-image writing lights. Latent-image-forming devices LFy to LHk, for example, consist of a light emitting diode (LED) array. Visible-image-forming device Uy corresponding to yellow includes rotating image holder PRy, charging unit CRy, latent-image-forming device LHy, developing device Gy, transfer unit T1*y*, and image holder cleaner CLy. Image holder PRy, charging unit CRy and image holder cleaner CLy comprise an image holder unit detachable from device body U2. Each of visible-image-forming devices Um, Uc, and Uk has the same configuration as visible-image-forming device Uy.

Image holders PRy, PRm, PRc, and PRk are charged by charging units CRy, CRm, CRc, and CRk, and latent images are formed on their surfaces by latent-image writing lights Ly, Lm, Lc, and Lk at image-writing positions Q1*y*, Q1*m*, Q1*c*, and Q1*k*, respectively. The latent images are developed in development areas Q2*y*, Q2*m*, Q2*c*, and Q2*k* with a developer on developing rollers R0*y*, R0*m*, R0*c*, and R0*k* (respective examples of developer holders of developing devices Gy, Gm, Gc, and Gk), by which development process they respectively become toner images. In this context, it is noted that a toner image is an example of a visible image. The toner images are carried to primary transfer areas Q3*y*, Q3*m*, Q3*c*, and Q3*k*, where each toner image contacts intermediate transfer belt B (an example of an intermediate transfer unit). In primary transfer areas Q3*y*, Q3*m*, Q3*c*, and Q3*k*, primary transfer units T1*y*, T1*m*, T1*c*, and T1*k* are each disposed at a side of intermediate transfer belt B opposite to that at which image holders PRy, PRm, PRc, and PRk are each disposed. To each of primary transfer units T1*y*, T1*m*, T1*c*, and T1*k* is applied a primary transfer voltage, which has a reverse polarity with a charging polarity of toner, from power supply circuit E controlled by controller C. Primary transfer units T1*y*, T1*m*, T1*c*, and T1*k* conduct primary transfer of toner images on image holders PRy to PRk to intermediate transfer belt B, respectively. After primary transfer of toner images, image holder cleaners CLy, CLm, CLc, and CLk respectively remove residue and other attached substances from a surface of image holders PRy, PRm, PRc, and PRk. In this way, the surfaces of image holders PRy, PRm, PRc, and PRk are cleaned. Then, the surfaces of image holders PRy, PRm, PRc, and PRk are charged again by charging units CRy, CRm, CRc, and CRk, respectively.

At the upper part of image holders PRy to PRk, belt module BM (an example of an intermediate transfer unit), which is movable in a vertical direction and can be pulled in a frontward direction, is disposed. Belt module BM includes intermediate transfer belt B, belt drive roller Rd (an example of a drive member for an intermediate transfer unit), tension roller Rt (an example of a tension member for an intermediate transfer unit), walking roller Rw (an example of a meander-prevention member), idler roller Rf (an example of a driven member), backup roller T2*a* (an example of a facing member with a secondary transfer area), and primary transfer units T1*y*, T1*m*, T1*c*, and T1*k*. Intermediate transfer belt B is rotatably supported by belt support rollers (an example of support members for an intermediate transfer unit), which consist of belt drive roller Rd, tension roller Rt, walking roller Rw, idler roller Rf, and backup roller T2*a*. Secondary transfer roller T2*b* (an example of a secondary transfer member) is disposed facing the surface of intermediate transfer belt B contacting backup roller T2*a*. Secondary transfer unit T2 consists of backup roller T2*a* and secondary transfer roller T2*b*. Secondary transfer roller T2*b* and intermediate transfer belt B form secondary transfer area Q4 therebetween. Primary transfer units T1*y*, T1*m*, T1*c*, T1*k* form a monochrome or multicolor toner image by sequentially overlapping and transferring respective toner images in each color in primary transfer areas Q3*y*, Q3*m*, Q3*c*, and Q3*k*. The monochrome or multicolor toner image is carried to secondary transfer area Q4.

At the lower part of visible-image-forming devices Uy to Uk, four pairs of left/right guide rails GR (an example of guide members) are provided. Guide rails GR movably support paper supply units TR1 to TR4 in the front-back direction of image-forming apparatus U. Each of pickup rollers Rp (an example of a medium pick up member) picks up sheets S stored in each of paper supply units TR1 to TR4, and each pair of retard rollers Rs (an example of a medium separating member) separates sheets S individually. Plural pairs of feed rollers Ra (an example of a medium transporting member) transport sheet S along sheet path SH (an example of a medium path) to registration roller Rr (an example of a registration member for a transportation timing to a transfer area), which is disposed at the upstream side of secondary transfer area Q4 in the sheet transport direction. A sheet-transporting device consists of sheet path SH, feed rollers Ra, registration roller Rs, and so on.

Registration roller Rr transports sheet S to secondary transfer area Q4 at a timing corresponding to one when a toner image formed on intermediate transfer belt B is transported in secondary transfer area Q4. Backup roller T2*a* is electrically grounded, and when sheet S passes through secondary transfer area Q4, a secondary transfer voltage, which has a reverse polarity to that of a polarity of the toner, is applied to secondary transfer roller T2*b* from power supply circuit E under control of controller C. Secondary transfer unit T2 transfers onto sheet S a toner image on intermediate transfer belt B during this period. After a secondary transfer of a toner image, intermediate transfer belt B is cleaned by belt cleaner CLb (an example of an intermediate transfer unit cleaner). In image-forming apparatus U, a transfer unit, which transfers to sheet S a toner image on the surface of image holders PRy to PRk, consists of primary transfer units T1*y* to T1*k*, intermediate transfer belt B, and secondary transfer unit T2. Sheet S onto which a toner image is transferred is transported to fixing area Q5, which is a pressure welding area between a heating roller Fh (an example of a heat fixing member) and pressure roller Fp (an example of a pressure fixing member) of fixing device F, and is heated and fixed while passing though the fixing area. Heated and fixed sheet S is outputted by output roller Rh (an example of a medium output member) on paper output unit TRh (an example of a medium output unit).

At the upper part of belt module BM, developer cartridges Ky, Km, Kc, and Kk are disposed. Developer cartridges Ky, Km, Kc, and Kk respectively store developer in yellow (Y), magenta (M), cyan (C), and black (K), and carry and replenish the developer to image-forming apparatus U. Developer stored in developer cartridges Ky, Km, Kc, and Kk is replenished to developing devices Gy, Gm, Gc, and Gk through developer replenishing paths (not shown), in response to consumption of developer by developing devices Gy, Gm, Gc, and Gk. Developer may be, for example, a two-component developer including magnetic carrier and toner with an external additive.

Image-forming apparatus U includes upper frame body UF and lower frame body LF. Upper frame body UF supports visible-image-forming devices Uy to Uk and members disposed at the upper part of visible-image-forming devices Uy to Uk, namely belt module BM and so on. Lower frame body LF supports guide rails GR that support paper supply units TR1 to TR4, a paper supply member that supply a sheet from each of paper supply units TR1 to TR4, namely pickup rollers Rp, retard rollers Rs, feed rollers Ra, and so on.

Figure 3:
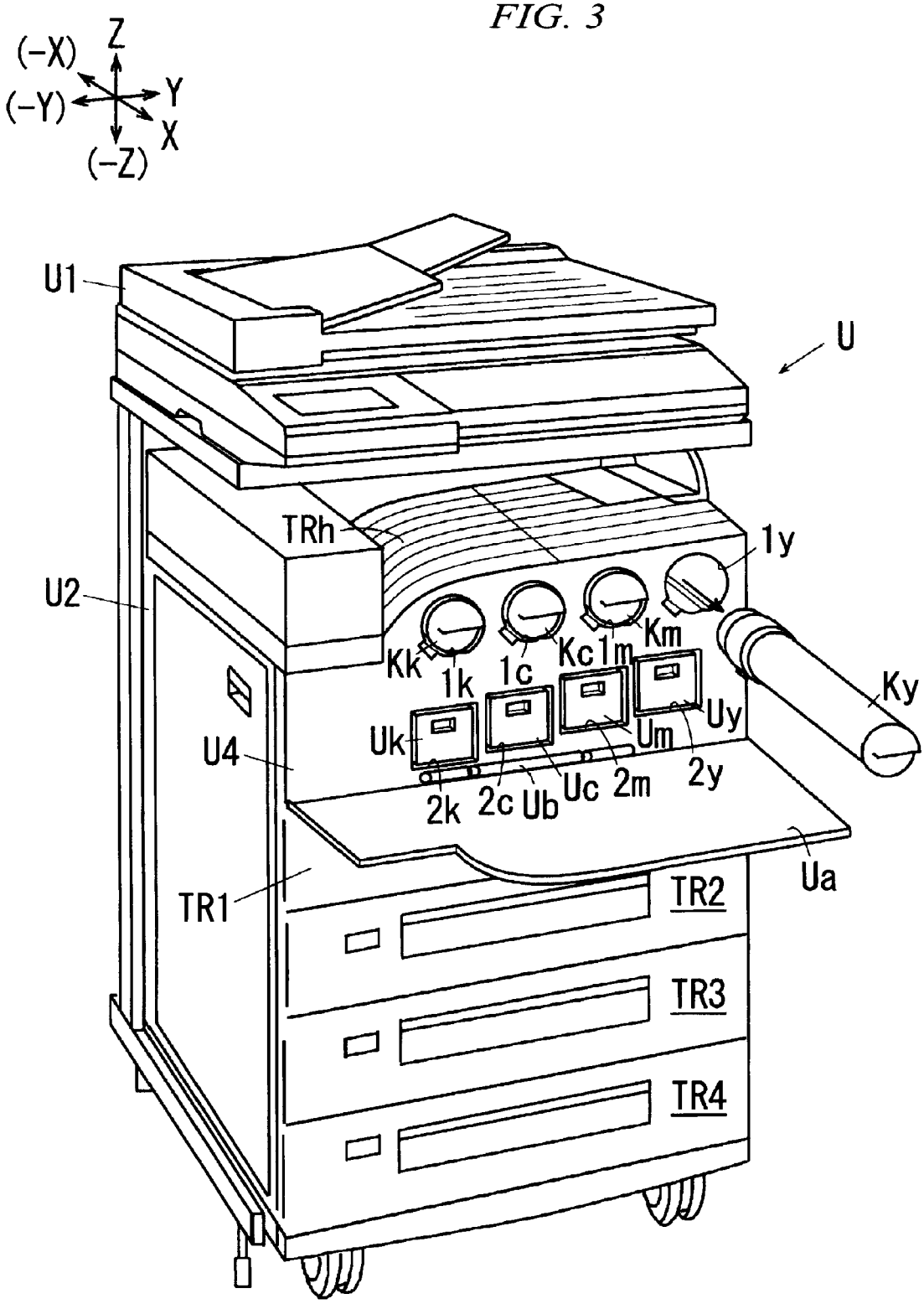
FIG. 3 is a perspective diagram of the image-forming apparatus.

FIG. 3 is a diagram describing a state of image-forming apparatus U when front cover Ua is opened and yellow developer cartridge Ky is removed. Device body U2 rotatably supports front cover Ua of image-forming apparatus U by hinge Ub. More specifically, front cover Ua is movable between a normal position (refer to FIG. 1) for when an image-forming operation is being performed or is in standby, and a maintenance position (refer to FIG. 3) for when maintenance such as replacement of developer cartridges Ky to Kk or visible-image-forming devices Uy, Um, Uc, Uk is being carried out. On the inside of front cover Ua, front panel U4 (an example of a front member of device body U2) is supported. On front panel U4, open-ended cylindrical mounting units 1*y*, 1*m*, 1*c*, 1*k* (an example of a mounting unit for a replenish cartridge) are formed, in which developer cartridges Ky to Kk for colors are respectively provided. In addition, on front panel U4, process cartridge mounting units 2*y*, 2*m*, 2*c*, and 2*k* (an example of a mounting unit for a visible-image-forming device) are formed, in which visible-image-forming units UY to UK are provided respectively.

Overall Structure of Developer Cartridge

Developer cartridges Ky to Kk have almost identical structures. Therefore, in the following description the structure of developer cartridge Ky will be described as an example of a structure of a developer cartridge.

Figure 4:
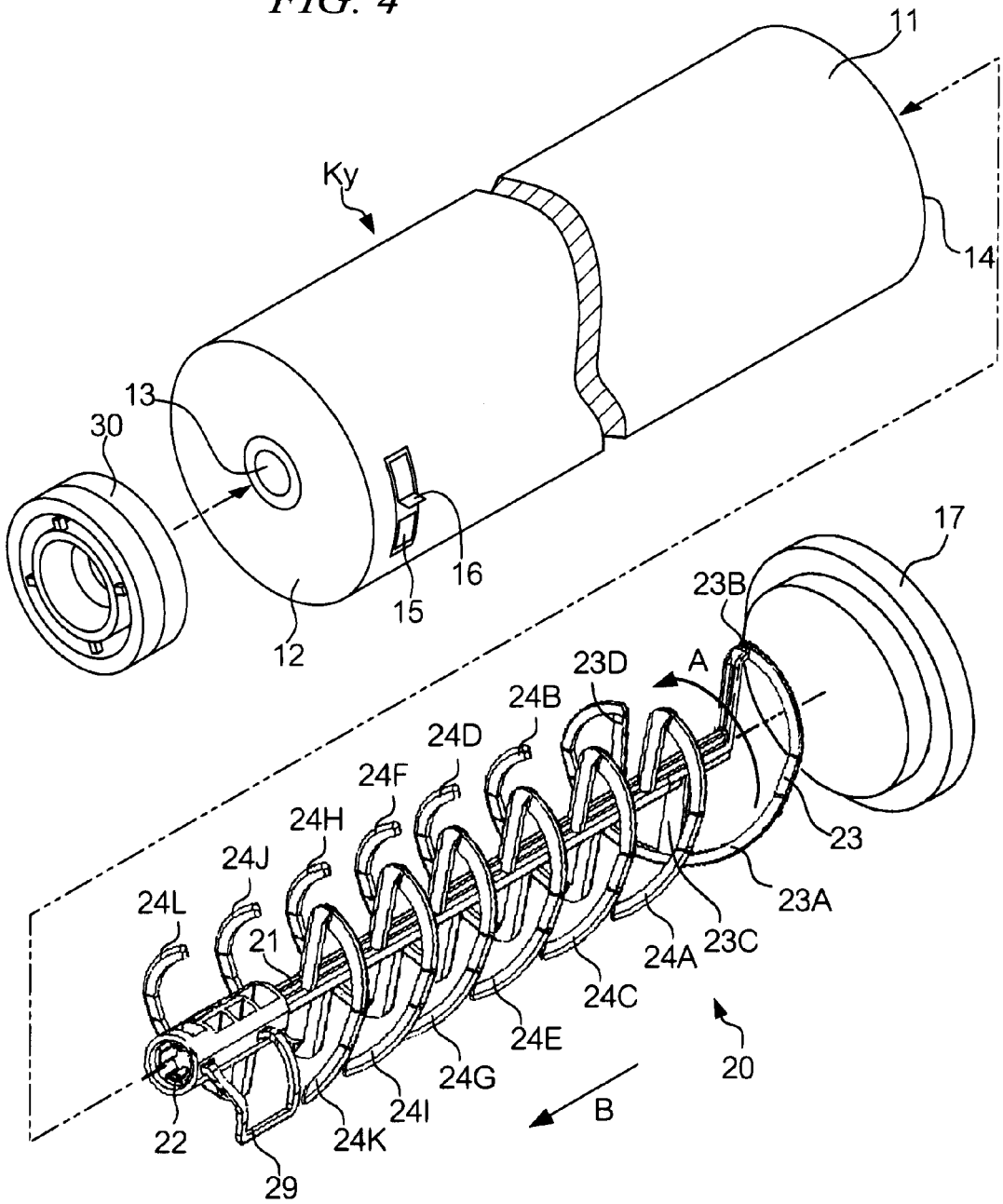
FIG. 4 is an exploded perspective diagram showing a structure of a developer cartridge according to the exemplary embodiment.

FIG. 4 is an exploded perspective diagram for describing a structure of developer cartridge Ky. Developer cartridge Ky includes cartridge body 11, cap member 17, conveyance member 20, and coupling 30. Cartridge body 11 is a cylindrical member, which is made from paper or plastic, and contains a cylindrical cartridge for storing developer. At end wall 12 of cartridge body 11, hole 13 is formed. Coupling 30 is partially inserted in hole 13. Close to end wall 12 on the outer circumference surface of cartridge body 11, developer outlet 15 is provided for transfer of developer to the developing device. On developer outlet 15, shutter 16 is provided to be movable reciprocally in a circumferential direction of the cartridge body 11 thereby to open and close developer outlet 15.

Shutter 16 closes developer outlet 15 when developer cartridge Ky is not attached to image-forming apparatus U, and opens developer outlet 15 when developer cartridge Ky is attached to image-forming apparatus U. Cap member 17 closes opening 14 of cartridge body 11 by insertion into or engagement with opening 14, to thereby provide an airtight enclosed cartridge chamber in developer cartridge Ky.

Cartridge body 11 contains conveyance member 20 having a length substantially equal to a length of the cartridge chamber in cartridge body 11. Conveyance member 20 may have, for example, a helical shape and is made from a thermoplastic resin material such as polypropylene (PP), high-density polyethylene (HDPE), polyamide (PA) or nylon, acrylonitrile-butadiene-styrene copolymer (ABS), polyphenylene ether alloy (PPE alloy), or polyacetal (POM). One end of rotating shaft 21 of conveyance member 20 is a free end that is not supported; another end of rotating shaft 21 is connected to coupling 30 inserted in hole 13. As coupling 30 is rotated in the direction of arrow A by a driving device (not shown) such as a motor provided in image-forming apparatus U, conveyance member 20 connected to coupling 30 is caused to rotate in the direction of arrow A. Accordingly, conveyance member 20 conveys developer stored in cartridge body 11 in the direction of conveyance indicated by arrow B (refer to FIG. 4 to FIG. 6).

Structure of Conveyance Member 20

Figure 5:
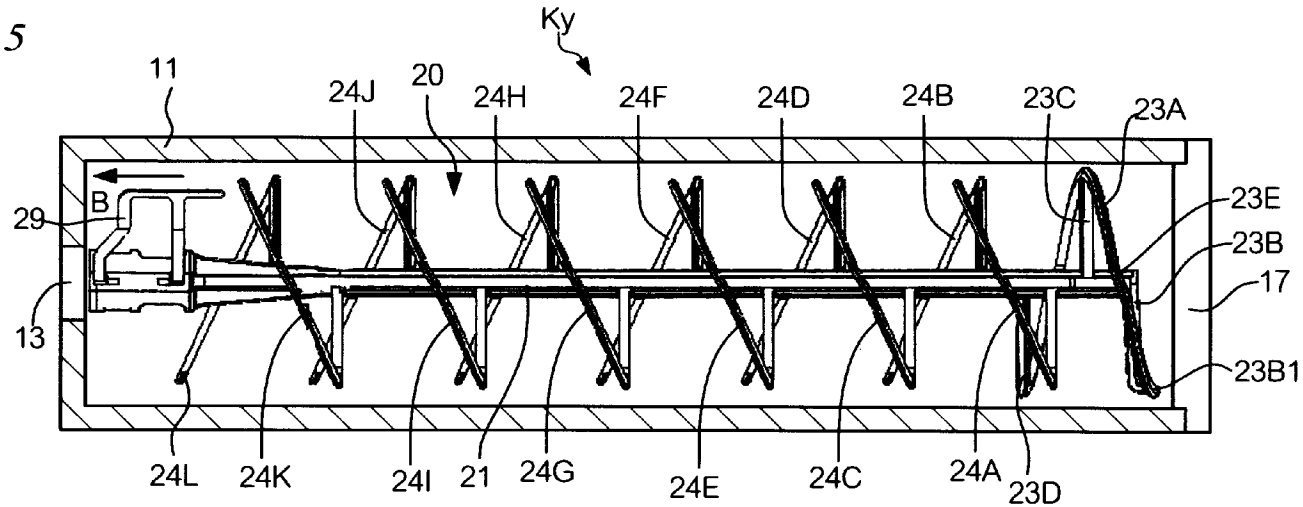
FIG. 5 is a vertical cross-sectional diagram showing the developer cartridge.
Figure 6:
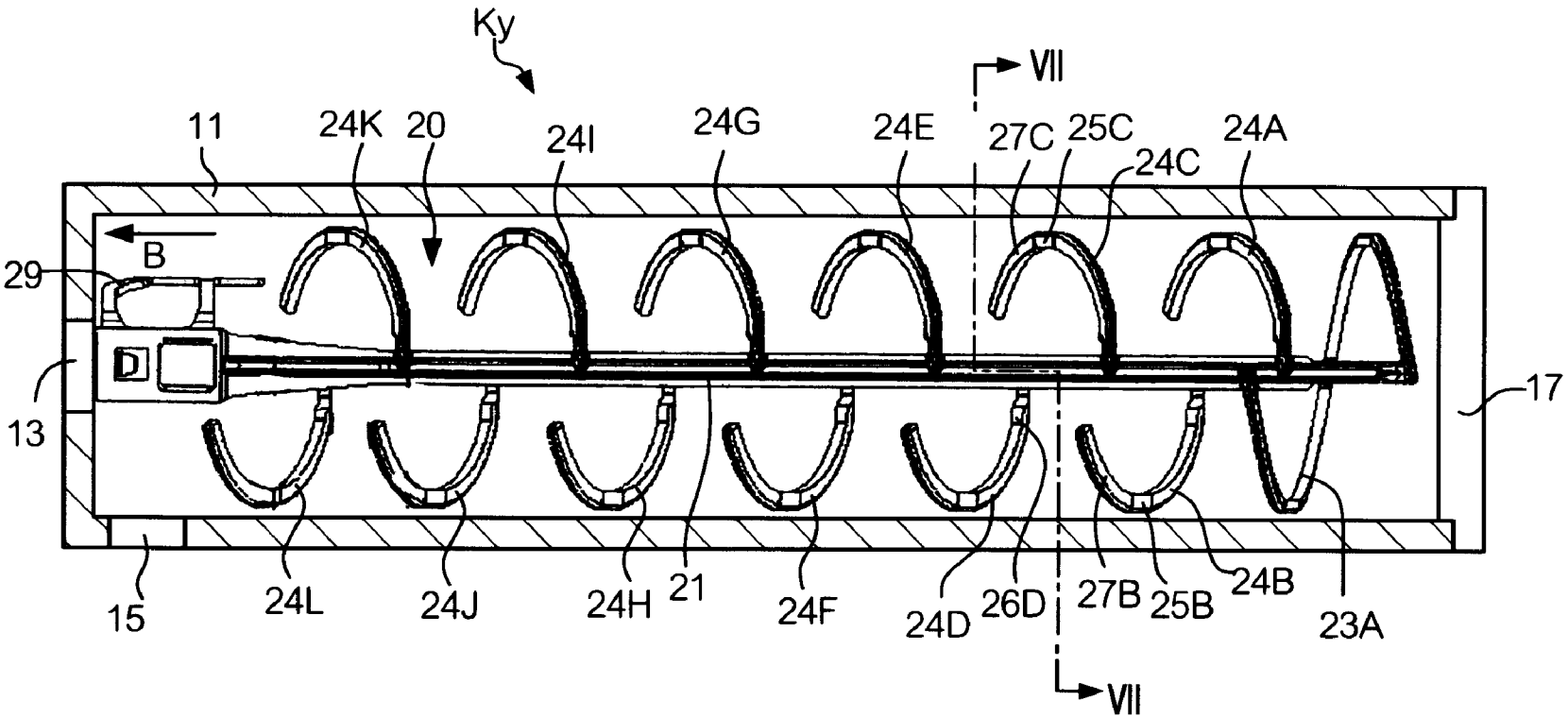
FIG. 6 is a horizontal cross-sectional diagram showing the developer cartridge.
Figure 7:
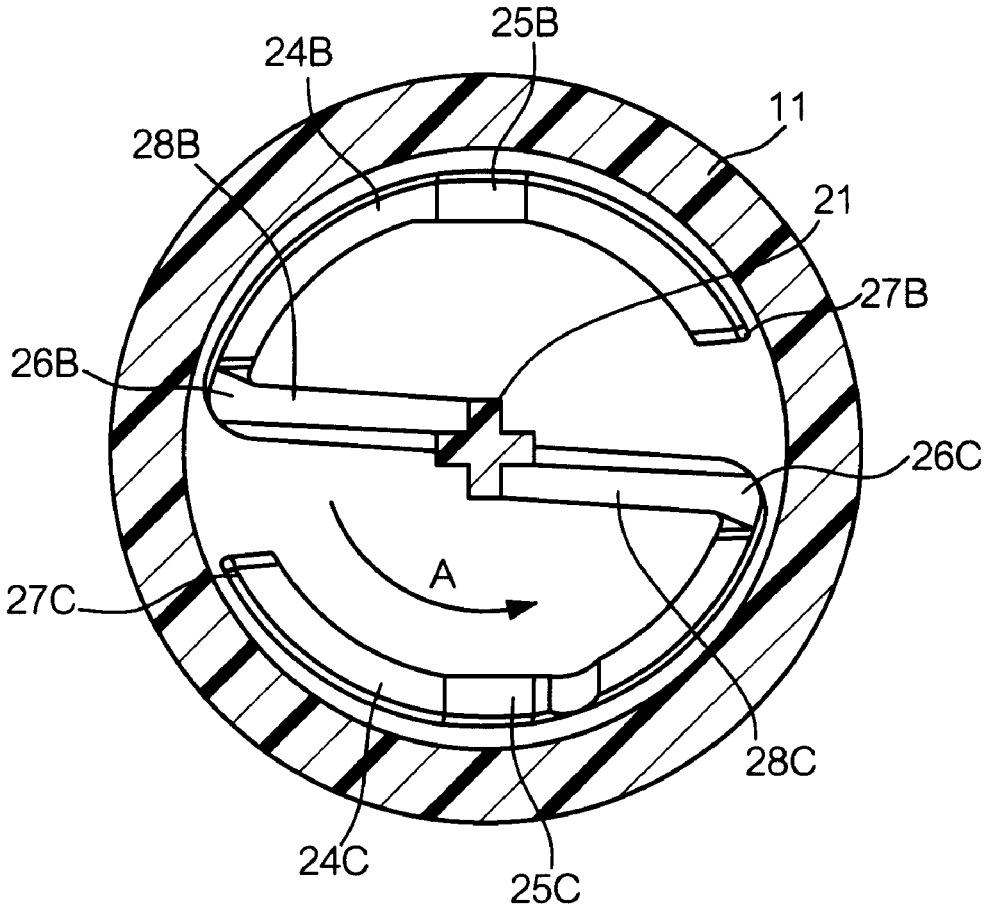
FIG. 7 is a cross-sectional diagram showing the developer cartridge as viewed in the direction of arrow VII-VII of FIG. 6.
Figure 8A:
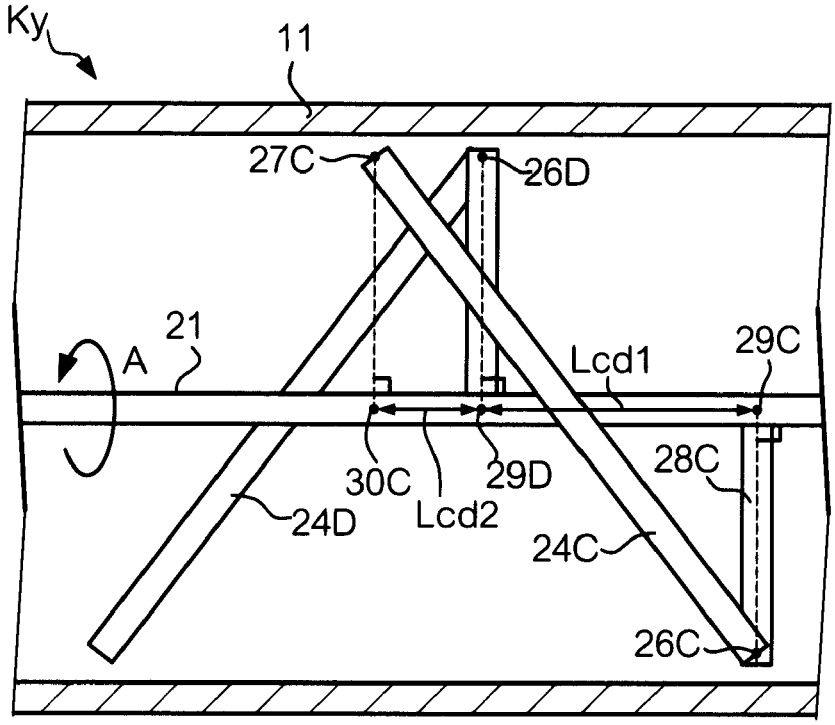
FIGS. 8A and 8B are enlarged diagrams of the vertical cross-sectional diagram of the developer cartridge.
Figure 8B:
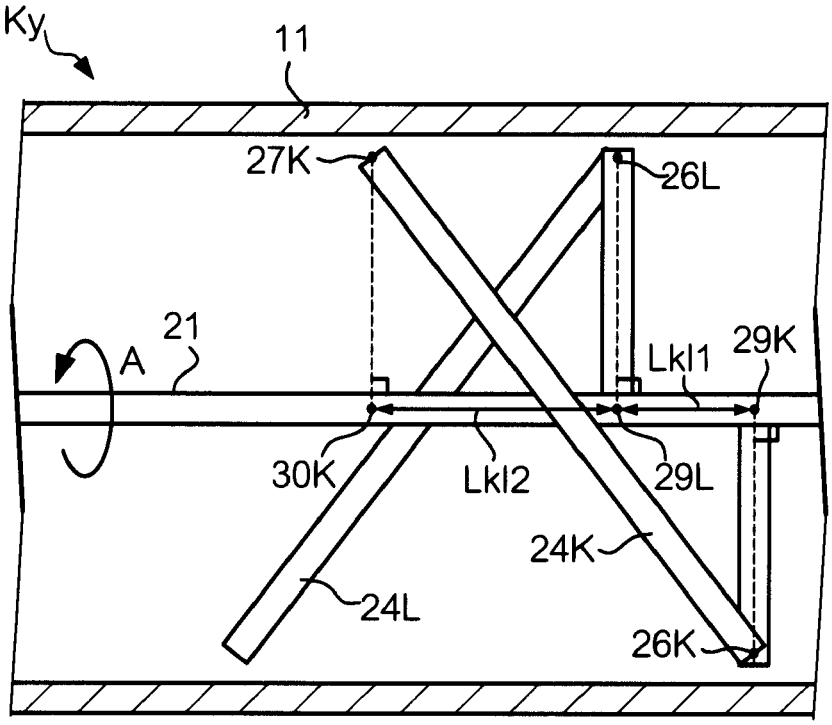

The structure of conveyance member 20 will now be described in more detail, with reference to FIG. 4 to FIG. 9. FIG. 5 is a vertical cross-sectional diagram of the developer cartridge. FIG. 6 is a horizontal cross-sectional diagram of the developer cartridge. FIG. 7 is a cross-sectional view in the direction of arrow VII-VII of FIG. 6.

Conveyance member 20 consists of rotating shaft 21, which shaft has a cross-shape in a cross section and has provided thereon a conveying member for conveyance of developer. The conveying member includes scrape member 23, twelve arc convey members 24A to 24L (an example of plural arcuate members), and output convey member 29. Scrape member 23 is connected to one end of rotating shaft 21. Arc convey members 24A to 24L are provided along an axial direction of rotating shaft 21. Discharge member 29 is connected to another end of rotating shaft 21. At another end of rotating shaft 21, attachment part 22 is provided to attach conveyance member 20 to coupling 30. Developer is conveyed along an axial direction of rotating shaft 21, from an opposite end to that where attachment part 22 is provided, to the end where attachment part 22 is provided. In other words, developer is conveyed from one end to another end in the direction indicated by arrow B.

In the following description, the end of rotating shaft 21 at the opposite end to that where attachment part 22 is provided refers to "upstream end," because the end is located at the upstream end along the direction of conveyance of developer. In contrast, the end of rotating shaft 21 at the end where attachment part 22 is provided refers to "downstream end," because the end is located at the downstream end along the direction of conveyance of developer.

Arc convey members 24A to 24L are arranged in a staggered manner in the axial direction of rotating shaft 21, from the upstream end toward the downstream end. Scrape member 23 is provided at the upstream end of rotating shaft 21. Arc convey members 24A to 24L are provided at the downstream side of scrape member 23 along the direction of conveyance of developer. Scrape member 23 and arc convey members 24A to 24L have slightly different functions. More specifically, scrape member 23 functions to scrape developer collected in an area near the upstream end of rotating shaft 21, and convey the developer in a direction toward the downstream end while agitating the developer. In contrast, arc convey members 24A to 24L function to convey developer, which has been conveyed by the conveying member located at the upstream side in the direction of conveyance of developer, toward the downstream side, while agitating the developer.

It is noted that in the following description, if it is not necessary to distinguish scrape member 23 and arc convey members 24A to 24L, they are collectively referred to as convey members 23, 24. Similarly, if it is not necessary to distinguish arc convey members 24A to 24L, they are collectively referred to as arc convey member 24.

Discharge member 29 has a substantially U-shaped form protruding from rotating shaft 21. Developer that has been conveyed from the upstream end to the downstream end along the direction of conveyance of developer finally accumulates near developer outlet 15. Discharge member 29 functions to push out accumulating developer from developer outlet 15 to the outside, while loosening the developer.

Structure of Scrape Member 23

Next, the structure of scrape member 23 is described. As shown in FIG. 4, scrape member 23 consists of arc part 23A having an outer edge forming a helical arc, and support parts 23B to 23D supporting arc part 23A. Each of arc part 23A and support parts 23B to 23D is a rod-shaped member having a predetermined thickness. There is a gap between rotating shaft 21, arc part 23A, and support parts 23B to 23D. Support parts 23B to 23D consist of first support part 23B, intermediate support part 23C, and second support part 23D. First support part 23B is a substantially linear member connected to the upstream end of rotating shaft 21, and it extends in the direction perpendicular to rotating shaft 21. Intermediate support part 23C is a substantially linear member located at the downstream side of first support member 23B along the direction of conveyance of developer, and is located clockwise by 180 degrees from first support part 23B in the direction of rotation of rotating shaft 21. Intermediate support part 23C extends in a direction perpendicular to rotating shaft 21. Second support member 23D is a substantially linear member located at the downstream side of intermediate support part 23C along the direction of conveyance of developer, and is located clockwise by 180 degrees from intermediate support part 23C in the rotating direction of rotating shaft 21. Second support member 23D extends in a direction perpendicular to rotating shaft 21.

A top end of first support member 23B supports one end of arc part 23A, and a top end of second support part 23D supports another end of arc part 23A. A top end of intermediate support part 23C supports arc part 23A near its center. As described above, intermediate support part 23C is located clockwise by 180 degrees from first support part 23B, and second support part 23D is located clockwise by 180 degrees from intermediate support part 23C. Accordingly, arc part 23A forms a helical arc having an opening angle of 360 degrees. The term "opening angle" refers to an angle between two vertical lines extended to rotating shaft 21 from each end of the arc part as viewed in the direction parallel to rotating shaft 21. In other words, an angle between two vertical lines extended from each end of the arc part 23A to rotating shaft 21 is 360 degrees.

As shown in FIG. 5, linear step parts 23E are provided between first support part 23B and intermediate support part 23C, and between intermediate part 23C and second support part 23D, respectively. Step part 23E has a linear form so that integral molding conveyance member 20 is easily removed from a metal pattern. However if the problem relating to integral molding is addressed, conveyance member 20 may have a curved form. First support part 23B includes protrusion part 23B1 protruding further toward the upstream end of rotating shaft 21. An end of protrusion part 23B1 supports an end of arc part 23A.

Structure of Discharge Member 29

Next, the structure of discharge member 29 is described. As shown in FIG. 6, discharge member 29 is provided at a position facing developer outlet 15 when conveyance member 20 is provided in cartridge body 11. When viewed in the direction perpendicular to rotating shaft 21, discharge member 29 at least partly overlaps with arc convey member 24L disposed on rotating shaft 21 at the furthermost downstream end along the direction of conveyance of developer.

Structure of Arc Convey Member 24

Next, the structure of arc convey member 24 is described. Here, arc convey members 24B, 24C located at the upstream side along the direction of conveyance of developer are described as examples of arc convey member 24, with reference to FIG. 7. It is noted that in FIG. 7 the last alphabetic letters of reference numerals have the same meaning as those of arc convey members 24A to 24L. In other words, reference numerals having alphabetic letters A to L indicate components of arc convey members 24A to 24L, respectively.

Arc convey members 24B, 24C respectively include arc parts 25B, 25C and support parts 28B, 28C. Arc parts 25B, 25C have fixed ends 26B, 26C and free ends 27B, 27C located backward of fixed ends 26B, 26C in the rotating direction, respectively. Each of support parts 28B, 28C extends from rotating shaft 21 in a radial direction of the cross-sectional surface of the cartridge chamber. Support parts 28B, 28C respectively support arc parts 25B, 25C by fixed ends 26B, 26C, so that each of arc parts 25B, 25C is inclined toward the axial direction of rotating shaft 21. In other words, one end of each of arc parts 25B, 25C is supported by support parts 28B, 28C, and another end of each of arc parts 25B, 25C extends in a direction other than the axial direction, so as to form an arc. Each of rotating shaft 21, arc parts 25B, 25C and support parts 28B, 28C is a rod-shaped member. There is a gap between rotating shaft 21, arc parts 25B, 25C, and support parts 28B, 28C.

As shown in FIG. 5 and FIG. 6, when viewed in a direction perpendicular to rotating shaft 21, adjacent arc convey members 24 along the axial direction of rotating shaft 21 are arranged such that they partly overlap each other. In an example of arc convey members 24B, 24C and 24D, support part 28C supporting fixed end 26C of arc convey member 24C is provided at the upstream side along the direction of conveyance of developer of free end 27B of arc convey member 24B that is located at the upstream side next to arc convey member 24C along the direction of conveyance of developer. Free end 27C of arc convey member 24C is located at the downstream side along the direction of conveyance of developer of support end 28D supporting fixed end 26D of arc convey member 24D that is located at the downstream side next to arc convey member 24C along the direction of conveyance of developer. The other adjacent convey members 24 are also arranged such that they partly overlap each other. Similarly, scrape member 23 and arc convey member 24A, discharge member 29 and arc convey member 24L respectively are arranged such that they partly overlap each other.

Here, a point where a vertical line extended from fixed end 26 of arc convey member 24 to rotating shaft 21 crosses rotating shaft 21 is referred to as fixed end position 29. A point where a vertical line extending from free end 27 of arc convey member 24 to rotating shaft 21 crosses rotating shaft 21 is referred to as free end position 30. An overlapping range in which adjacent arc convey members 24 partly overlap each other is described below in detail.

Overlapping areas in which adjacent arc convey members 24 partly overlap become greater from the upstream end to the downstream end of rotating shaft 21. This will be explained in detail with reference to an example of arc convey members 24C, 24D shown in FIG. 8A and arc convey members 24K, 24L shown in FIG. 8B. When "Lcd1" indicates a distance from fixed end position 29C of arc convey member 24C to fixed end position 29D of arc convey member 24D, and "Lkl1" indicates a distance from fixed end position 29K of arc convey member 24K to fixed end position 29L of arc convey member 24L, a relation between those distances is $Lkl1<Lcd1$. Accordingly, when "Lcd2" indicates a distance from free end position 30C of arc convey member 24C to fixed end position 29D of arc convey member 24D, and "Lkl2" indicates a distance from free end position 30K of arc convey member 24K to fixed end position 29L of arc convey member 24L, a relation between those distances is $Lkl2>Lcd2$. In other words, when each of distances from free end position 30 of arc convey member 24 disposed at the upstream side, to fixed end position 29 of arc convey member 24 disposed at the downstream side, between adjacent arc convey members 24 disposed on rotating shaft 21, refers to overlapping distance (an example of a length of an overlapping area), the overlapping distance between arc convey member 24 disposed at the furthermost downstream end and arc convey member 24 adjacent to it is the longest, and the overlapping distances shorten from the downstream end to the upstream end.

When conveyance member 20 (arc convey member 24) rotates in the direction of arrow A in developer cartridge Ky, two arc parts 24 push and convey developer to the downstream side along the direction of conveyance of developer, in an overlapping area of adjacent arc convey members 24. In general, to stabilize an amount of developer discharged from developer outlet 15, the structure and the performance of developer cartridge are such that an amount of developer discharged from developer outlet 15 is smaller than an amount of developer conveyed by conveyance member 20. However, disharging developer having an amount smaller than an amount of developer conveyed in developer cartridge Ky means that an amount of developer existing at the downstream end along the direction of conveyance of developer increases as developer continues to be conveyed. Therefore, if overlapping distances of conveyance member 20 were almost the same, a force of developer acting on arc convey members 24 disposed at the downstream end along the convey direction of conveyance member 20 would become greater than a force of developer acting on arc convey members 24 disposed at the upstream end.

Accordingly, as described above, the overlapping distances are the longest between arc convey member 24 disposed at the furthermost downstream end along the direction of conveyance of developer and arc convey member 24 adjacent to it, and the distances become progressively shorter from the downstream end toward the upstream end. In other words, arc convey members 24 disposed at the downstream end along the direction of conveyance of developer are provided on rotating shaft 21 such that the overlapping distance becomes longer, for a purpose of reducing a force of developer acting on arc convey members 24. In the overlapping area of conveyance member 20, a force of developer acting on each of arc convey members 24 is reduced, but a force from two arc convey members 24 acts on developer in the overlapping area. Therefore, pressure occurring in a unit length in the axial direction of conveyance member 20 between conveyance member 20 and developer becomes greater. When the force acting from conveyance member 20 on developer located in the overlapping area becomes greater, developer adheres to each other, and developer clumps easily occur. On the other hand, developer accumulated at the downstream end along the direction of conveyance of developer is outputted from developer outlet 15 and is sent to the developing device in a shorter time, compared with developer accumulated at the upstream end along the direction of conveyance of developer. Therefore, developer accumulated at the downstream end is not subjected to a greater force from arc convey members 24 for an extended period, and developer clumps due to adhering of developer hardly occur.

Figure 9B:
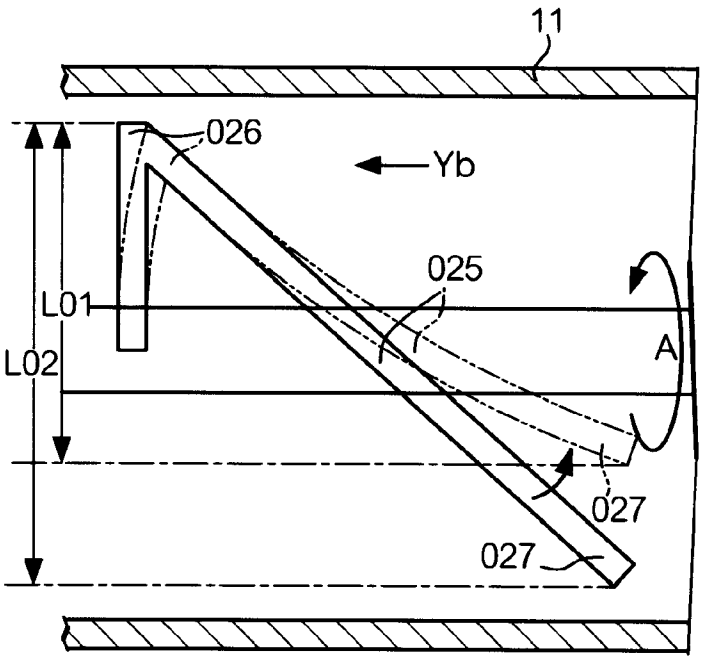
FIGS. 9A and 9B are schematic diagrams for describing a deformation and conveyance performance of an arc convey member.
Figure 9A:
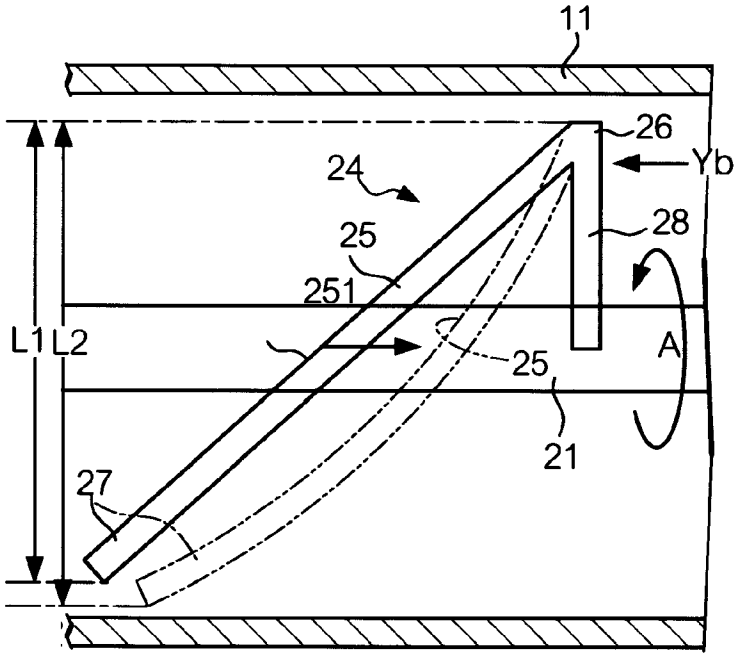

An effect of conveyance member 20 (arc convey member 24) will now be described with reference to FIGS. 9A and 9B. FIGS. 9A and 9B are schematic diagrams showing a deformation state that occurs during conveyance of developer.

In developer cartridge Ky, when conveyance member 20 (arc convey member 24) rotates in the direction of arrow A, arc part 25 becomes deformed owing to a force of developer thereon while arc part 25 pushes and conveys developer.

If coiled metallic conveyance member 20, which is coiled into a helical form, is substituted with a resin conveyance member, there is a problem that the helical form will expand owing to insufficient conveyance member strength, arc part 25 will touch and rub against the inner surface of cartridge body 11, and a drive force needed to drive conveyance member 20, namely torque, will become high. In addition, there is a possibility that conveyance member 20 will become deformed and bent, or be broke, owing to contact with the inner surface of cartridge body 11. It is conceivable to provide many support parts 24 extending from rotating shaft 21 to arc part 25 in the radial direction, for a purpose of reinforcing helical arc convey member 24. However, in this case also, expansion of the helical form is not prevented sufficiently, arc part 25 touches the inner surface of cartridge body 11, and the torque becomes high.

Meanwhile, in conveyance member 20 according to the exemplary embodiment free end 27 in a cantilever state displaces a force, or becomes deformed so as to ward off a force acting on arc part 25.

Accordingly, in the present exemplary embodiment, even if resin having a strength lower than metal is used as a material of conveyance member 20, there is provided conveyance member 20 whose convey resistance and driving torque is not excessively great, that is not easily damaged, and whose raw material and manufacturing costs in high-volume manufacturing are reduced.

Conveyance member 20 having such a structure that a force is easily warded off and convey resistance is reduced returns to its original form owing to its elasticity, when plastic deformation of arc part 25 under load is reduced and conveyance member 20 is not loaded with developer. Accordingly, conveyance member 20 according to the present exemplary embodiment has improved restoration properties after deformation due to a force received during conveyance of developer, compared with a conventional metallic conveyance member. In other words, arc parts 25 of conveyance member 20 become plastically deformed sequentially, and conveyance performance cannot easily vary.

FIGS. 9A and 9B are diagrams for describing a deformation and conveyance performance of the convey unit. FIG. 9A is a schematic diagram for describing the deformation and the conveyance performance, when the conveying unit extends toward the downstream end as in the exemplary embodiment. FIG. 9B is a diagram showing a deformation and conveyance performance, when the conveying unit extends toward the upstream end. As shown in FIG. 6, FIG. 7, FIG. 8, and FIG. 9A, arc parts 25 of conveyance member 20 according to the present exemplary embodiment, which are disposed in a helical configuration, extends toward the downstream end in direction of conveyance of developer Yb. If arc part 25 extends toward the upstream end in direction of conveyance of developer Yb as shown in FIG. 9B, free end 27 of arc part 25 becomes deformed as indicated by a dotted line shown in FIG. 9B. In this case, length L01 after the deformation from fixed part 26 to free end 27 of arc part 25, becomes shorter than length L02 before the deformation. Lengths L01 and L02 respectively correspond to an effective area in which developer is conveyed to the downstream end, thus in the structure shown in FIG. 9B conveyance of developer is reduced as a result of the deformation.

Meanwhile, in the structure shown in FIG. 9A, when arc part 25 becomes deformed owing to a force acting thereon during agitating and conveying of developer, length L2 after the deformation is longer than length L1 before the deformation, thus conveyance of developer is hardly reduced. In addition, a part receiving a force on front surface 251 of arc part 25 is inclined to the direction of conveyance of developer Yb before the deformation, but after the deformation, the part is almost perpendicular to direction of conveyance of developer Yb. Accordingly, a reduction of performance of pushing and conveying developer is prevented.

Modification

The above exemplary embodiment may be modified as described below.

(1) In the above exemplary embodiment, it is assumed that an overlapping distance between arc convey member 24 disposed at the furthermost downstream end along the direction of conveyance of developer and arc convey member 24 adjacent to it is an overlapping distance in the predetermined overlapping area, and the overlapping distance become shorter from the downstream end toward the upstream end. However, this is an example only of a relation between overlapping distances. When focusing attention only on a structure of conveyance member 20, an overlapping distance in an overlapping area of at least one of arc convey members 24, in which a force is greater than that acting on another arc convey member 24, may be longer than an overlapping distance in another overlapping area, which is closer to the upstream end (one end) than the downstream end (the other end) along the convey direction of rotating shaft 21. Accordingly, only an overlapping distance between arc convey member 24 disposed at the furthermost downstream end along the direction of conveyance of developer (the other end) and arc convey member 24 adjacent to it may be longer, and all other overlapping distances may be the same as each other. Moreover, not only the overlapping distance between arc convey member 24 disposed at the furthermost downstream end along the direction of conveyance of developer (the other end) and arc convey member 24 adjacent to it, but also an overlapping distance between this arc convey member 24 and arc convey member 24 adjacent to it may be longer, and all other overlapping distances may be the same as each other.

In addition, if a position relation of conveyance member 20 and the developer cartridge are taken into consideration, an overlapping distance along the axial direction of rotating shaft 21 at least in the predetermined overlapping area, which is the closest overlapping area to developer outlet 15 among overlapping areas in which adjacent arc convey members 24 along the axial direction of rotating shaft 21 overlap each other, may be longer than those in the other overlapping areas.

To stabilize an amount of developer outputted from developer outlet 15 per unit of time, an inclination, a width size, a diameter, a length, or the like of arc convey member 24 located closest to developer outlet 15 may be changed from those of arc convey member 24 disposed at the upstream side along convey direction, to thus reduce conveyance performance of developer per unit of time. In this case, a force of developer acting on arc convey member 24 located closest to developer outlet 15 becomes relatively small, thus it is conceivable that an overlapping distance in an overlapping area located closest to developer outlet 15 is not longer than overlapping distances in the other overlapping areas. In this case, an overlapping area disposed at or after the second position from developer outlet 15, other than the overlapping area closest to developer outlet 15, may become the predetermined overlapping area.

(2) In the above exemplary embodiment, conveyance member 20 includes one scrape member 23 provided at one end of rotating shaft 21, and twelve arc convey members 24A to 24L provided along the axial direction of rotating shaft 21. However, conveyance member 20 may include any number of scrape members 23 and arc convey members 24.

Figure 10:
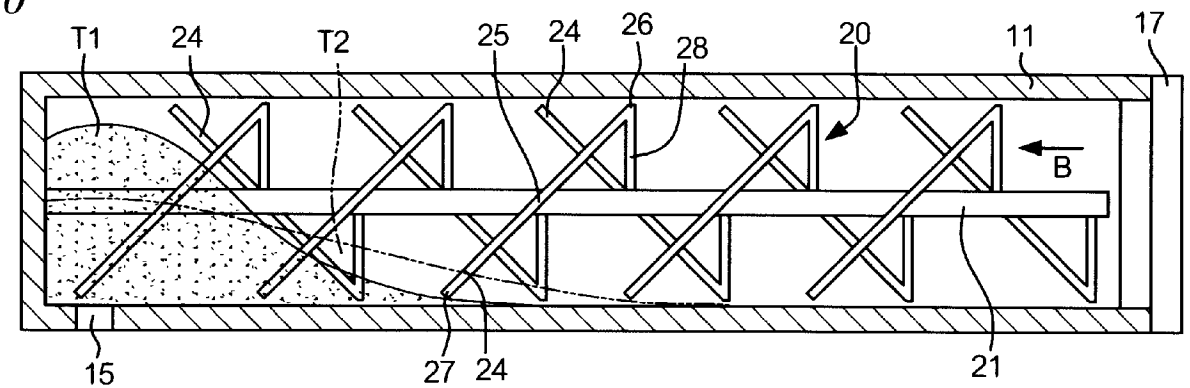
FIG. 10 is a diagram showing a state of conveyed developer according to modified example (3)

(3) In the above exemplary embodiment, conveyance member 20 includes plural identically shaped arc convey members 24 disposed along the axial direction of rotating shaft 21. As described above, the conveyance member 20 conveys developer in cartridge body 11 from the upstream end to downstream end by rotating. Conveyed developer accumulates near developer outlet 15 in state T1 shown in FIG. 10. However, developer cannot remain in state T1 and collapses because it is atomized, and it becomes in state T2 indicated by a dot-dot-dash line of FIG. 10. Accordingly, an arrangement of conveyance members 20 may be changed to vary a conveying force for developer.

Figure 11:
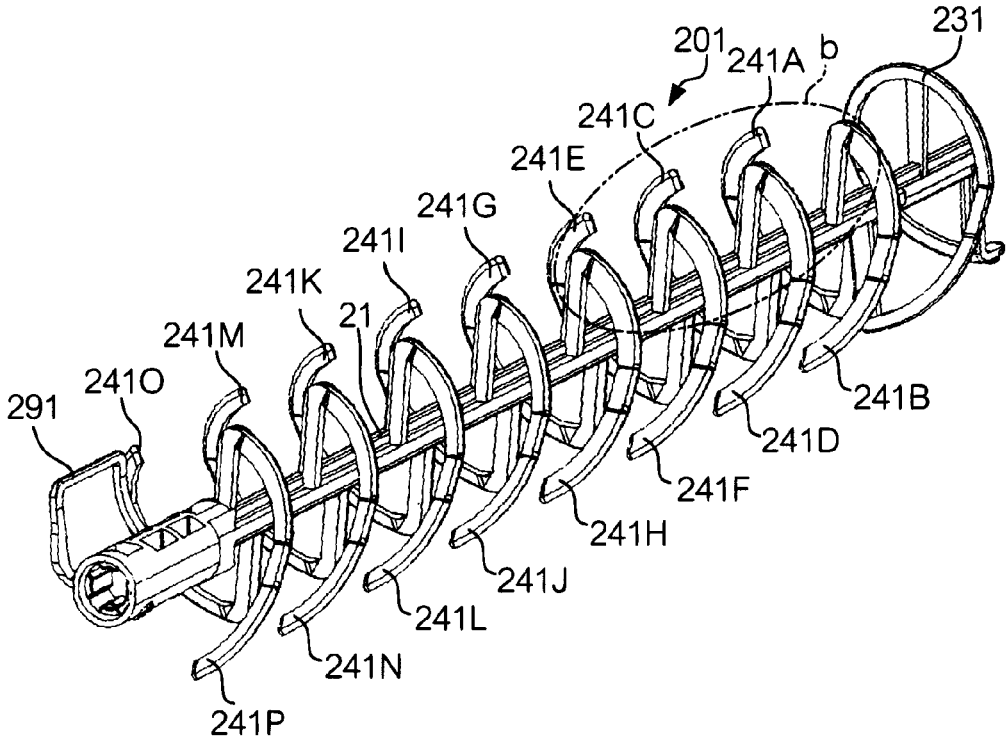
FIG. 11 is a perspective diagram showing a conveyance member according to modified example (3)

More specifically, conveyance member 201 is arranged as shown in FIG. 11. In details, conveyance member 201 is formed almost the same as conveyance member 20 described in the exemplary embodiment, and it includes scrape member 231 formed on one end of rotating shaft 21, discharge member 291 formed on another end of rotating shaft 21, and arc convey members 241 A to 241 P formed between those members. Each of wide measurements of arc parts 25 of arc convey members 241A to 241H, among arc convey members 241A to 241P, located at the upstream side along the direction of conveyance of developer (area b) is formed so as to be greater than that of the other arc parts 25, and each of wide measurements of art parts 25 of arc convey members 241I to 241P located at the downstream side along the direction of conveyance of developer is formed so as to be smaller than that of the other arc parts 25. This wide measurement refers to, for example, a width of arc part 25 when viewed in the axial direction of rotating shaft 21.

When using such a shaped conveyance member 201, conveyance performance of arc part 25 located at the upstream end is higher than that of arc part 25 located at the downstream end. Therefore, conveyed developer accumulates in state T1, and an amount of developer located at the downstream end along the direction of conveyance of developer increases. In this case, a greater force acts from developer on arc convey member 241, which is located at the downstream side along the convey direction of conveyance member 201. Therefore, when an overlapping distance in an overlapping area at the downstream end along the direction of conveyance of developer is longer than that in another overlapping area, a force of developer acting on each of arc convey members 241 is reduced.

Figure 12:
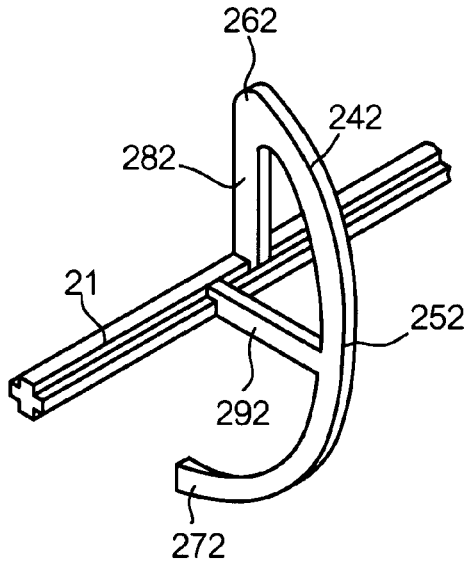
FIG. 12 is a perspective diagram showing an arc convey member according to modified example (4).

(4) In the above exemplary embodiment, support part 28 extended in the radial direction cantileverly supports fixed end 26 of arc part 25. However, the present invention is not limited to this aspect, but the arc convey member may be formed as shown in FIG. 12. Arc convey member 242 according to this modified example (4) includes arc part 252, support part 282, and reinforcement part 292. Arc part 252 has fixed end 262 and free end 272 backward of fixed end 262 in the rotating direction. Support part 282 supports fixed end 262 on rotating shaft 21, so that arc part 25 is inclined toward the axial direction of rotating shaft 21. Reinforcement part 292 is provided at a position rotated by 90 degrees from support part 282 having rotating shaft 21 at the center, and reinforces and supports arc unit 252. When in use arc convey member 242 is configured such that reinforcement part 292 reduces a displacement in the diameter direction of arc part 252.

In addition, in the exemplary embodiment, support part 28 extends in a radial direction of rotating shaft 21, and an extending direction of support part 28 is approximately perpendicular to the axial direction of rotating shaft 21. However the extending direction of support part 28 is not thus limited if it crosses the axial direction of rotating shaft 21.

(5) A material of conveyance member 20 is not limited to resin if it is a material having appropriate elasticity or flexibility. Conveyance member 20 may not be integrally molded, but each of manufactured members such as a rotating shaft, arc parts and a support part may be fixed by fastening means.

(6) In the above exemplary embodiment, the outer diameter of developer cartridge Ky consists of cartridge body 11, and cap member 17, which closes opening 14 of cartridge body 11. However, the present invention is not limited to this aspect. The developer cartridge may be formed so that cap members close openings at both ends of the cartridge body.

(7) In the above exemplary embodiment, each of developer cartridges Ky, Km, Kc, Kk of conveyance members 20 has the same configuration. However, the present invention is not limited to this aspect. The configuration of conveyance member 20 may be changed for each of the developer cartridges. For example, only black developer cartridge Kk, which is frequently used, may be formed in high capacity, and the demister or the formation of conveyance member 20 may be changed in accordance with this formation in high capacity.

(8) Conveyance member 20 consists of rotating shaft 21, which shaft has a cross-shape in a cross section and has provided thereon a conveying member for conveyance of developer. However, the cross-sectional shape of rotating shaft 21 is not limited to a cross-shape, and may be circular. Also, the cross-sectional shape of rotating shaft 21 does not have to be uniform, and may have partly wider area corresponding to a force acting on the conveying unit.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conveyance member comprising:

a rotating shaft;

a plurality of support members that extend from the rotating shaft in a direction crossing an axial direction of the rotating shaft; and a plurality of arcuate members each having one end supported respectively by one of the support members, and having another end extending in a direction other than the axial direction so as to form an arc, wherein:

when viewed in a direction perpendicular to the axial direction, there are a plurality of overlapping areas in which adjacent arcuate members overlap in the axial direction; and a length of at least one of the plurality of overlapping areas close to one end of the rotating shaft is greater than a length of each of the overlapping areas in the axial direction toward another end of the rotating shaft.

2. The conveyance member according to claim 1, wherein the rotating shaft is substantially cross-shaped in cross-section.

3. The conveyance member according to claim 1, wherein the plurality of arcuate members are arranged in a substantially staggered manner in the axial direction.

4. The conveyance member according to claim 1, further comprising a scrape member provided at the rotating shaft.

5. The conveyance member according to claim 1, further comprising a substantially U-shaped discharging member provided at the rotating shaft.

6. The conveyance member according to claim 1, further comprising a scrape member provided closer to the other end of the rotating shaft than the plurality of arcuate members.

7. A developer cartridge comprising:

a cartridge body that includes a cartridge chamber containing developer and an outlet for outputting the developer from the cartridge chamber; and a conveyance member that rotates in the cartridge body, and includes:

a rotating shaft;

a plurality of support members that extend from the rotating shaft in a direction crossing an axial direction of the rotating shaft; and a plurality of arcuate members each having one end supported respectively by one of the support members, and having another end extending in a direction other than the axial direction so as to form an arc, wherein:

when viewed in a direction perpendicular to the axial direction, there are a plurality of overlapping areas in which adjacent arcuate members overlap in the axial direction; and a length of at least one of the plurality of overlapping areas close to one end of the rotating shaft is greater than a length of each of the overlapping areas in the axial direction toward another end of the rotating shaft.

8. The developer cartridge according to claim 7, wherein the rotating shaft is substantially cross-shaped in cross-section.

9. The developer cartridge according to claim 7, wherein the plurality of arcuate members are arranged in a substantially staggered manner in the axial direction.

10. The developer cartridge according to claim 7, further comprising a scrape member provided at the rotating shaft.

11. The developer cartridge according to claim 7, further comprising a substantially U-shaped discharging member provided at the rotating shaft.

12. The developer cartridge according to claim 7, further comprising a scrape member provided closer to the other end of the rotating shaft than the plurality of arcuate members.

13. An image-forming apparatus comprising:

an image holder that holds an image;

a latent-image-forming unit that forms a latent image on the image holder;

a developing unit that develops the latent image;

a transfer unit that transfers the developed image onto a recording medium;

a fixing unit that fixes the transferred image to the recording medium;

a cartridge body that includes a cartridge chamber containing developer and an outlet for outputting the developer from the cartridge chamber; and a conveyance member that rotates in the cartridge body, and includes:

a rotating shaft;

a plurality of support members that extend from the rotating shaft in a direction crossing an axial direction of the rotating shaft; and a plurality of arcuate members each having one end supported respectively by one of the support members, and having another end extending in a direction other than the axial direction so as to form an arc, wherein:

when viewed in a direction perpendicular to the axial direction, there are a plurality of overlapping areas in which adjacent arcuate members overlap in the axial direction; and a length of at least one of the plurality of overlapping areas close to one end of the rotating shaft is greater than a length of each of the overlapping areas in the axial direction toward another end of the rotating shaft.

14. The image-forming apparatus according to claim 13, wherein the rotating shaft is substantially cross-shaped in cross-section.

15. The image-forming apparatus according to claim 13, wherein the plurality of arcuate members are arranged in a substantially staggered manner in the axial direction.

16. The image-forming apparatus according to claim 13, further comprising a scrape member provided at the rotating shaft.

17. The image-forming apparatus according to claim 13, further comprising a substantially U-shaped discharging member provided at the rotating shaft.

18. The image-forming apparatus member according to claim 13, further comprising a scrape member provided closer to the other end of the rotating shaft than the plurality of arcuate members.

* * * * *